US007857936B2

(12) United States Patent
Ahn

(10) Patent No.: US 7,857,936 B2
(45) Date of Patent: Dec. 28, 2010

(54) METHOD FOR MANUFACTURING CAKE DECORATING ACCESSORY AND THE DECORATING ACCESSORY

(76) Inventor: Heon-Sang Ahn, 437-2, Deokdo-ri, Gwangjeok-myeon, Yangju-si, Gyeonggi-do 482-843 (KR)

( * ) Notice: Subject to any disclaimer, the term of this patent is extended or adjusted under 35 U.S.C. 154(b) by 1083 days.

(21) Appl. No.: 11/596,154

(22) PCT Filed: Sep. 9, 2004

(86) PCT No.: PCT/KR2004/002298

§ 371 (c)(1),
(2), (4) Date: Nov. 10, 2006

(87) PCT Pub. No.: WO2005/118310

PCT Pub. Date: Dec. 15, 2005

(65) Prior Publication Data

US 2008/0260973 A1 Oct. 23, 2008

(30) Foreign Application Priority Data

Jun. 2, 2004 (KR) ..... 10-2004-0040138

(51) Int. Cl.
*B44C 3/00* (2006.01)
*B44C 5/00* (2006.01)

(52) U.S. Cl. ..... 156/248; 156/257; 156/263; 156/269; 156/268; 156/300; 156/277

(58) Field of Classification Search ..... 156/248, 156/300, 299, 268, 257, 263, 269, 62, 67, 156/249, 277, 278, DIG. 51
See application file for complete search history.

(56) References Cited

U.S. PATENT DOCUMENTS

| | | | | |
|---|---|---|---|---|
| 509,169 | A * | 11/1893 | Ireland | 73/170.16 |
| 4,605,579 | A * | 8/1986 | Armeno et al. | 428/66.7 |
| 4,721,455 | A * | 1/1988 | Barfus | 431/295 |
| 5,223,958 | A * | 6/1993 | Berry | 349/20 |
| 7,077,928 | B2 * | 7/2006 | Bethune | 156/248 |
| 2003/0172567 | A1 * | 9/2003 | Zentner et al. | 40/591 |
| 2004/0224271 | A1 * | 11/2004 | Langsam | 431/295 |

FOREIGN PATENT DOCUMENTS

| | | |
|---|---|---|
| DE | 2 698 199 | * 11/1992 |
| DE | FR 2 798 274 | * 9/1999 |
| JP | 10340609 | 12/1998 |
| KR | 1999015955 | 3/1999 |
| KR | 20000196414 | 7/2000 |
| KR | 20040040637 | 5/2004 |
| KR | 20030017031 | 6/2005 |

* cited by examiner

*Primary Examiner*—Linda L. Gray
(74) *Attorney, Agent, or Firm*—Cantor Colburn LLP

(57) ABSTRACT

The present invention provides a method for manufacturing a cake decorating accessory and the decorating accessory, which is used in producing a more dramatic and attractive atmosphere at a celebratory event by displaying a congratulatory message using heat. The method includes a step (S100) of preparing a base paper (77), a step (S200) of preparing a thermo-chromatic film (80), a step (S300) of writing or drawing a desired letter or picture for congratulatory messages on the base paper (77); a step (S400) of attaching the base paper (77), and a step (S500) of attaching the thermo-chromatic film (80) over the base paper (77). The base paper (77) has a raw paper layer (76) and a first bonding agent layer (72). The thermo-chromatic film (80) has a second bonding agent layer (82), a transparent synthetic resin film layer (84) and an oil-based microcapsule ink layer (86).

6 Claims, 8 Drawing Sheets

【Figure 1】
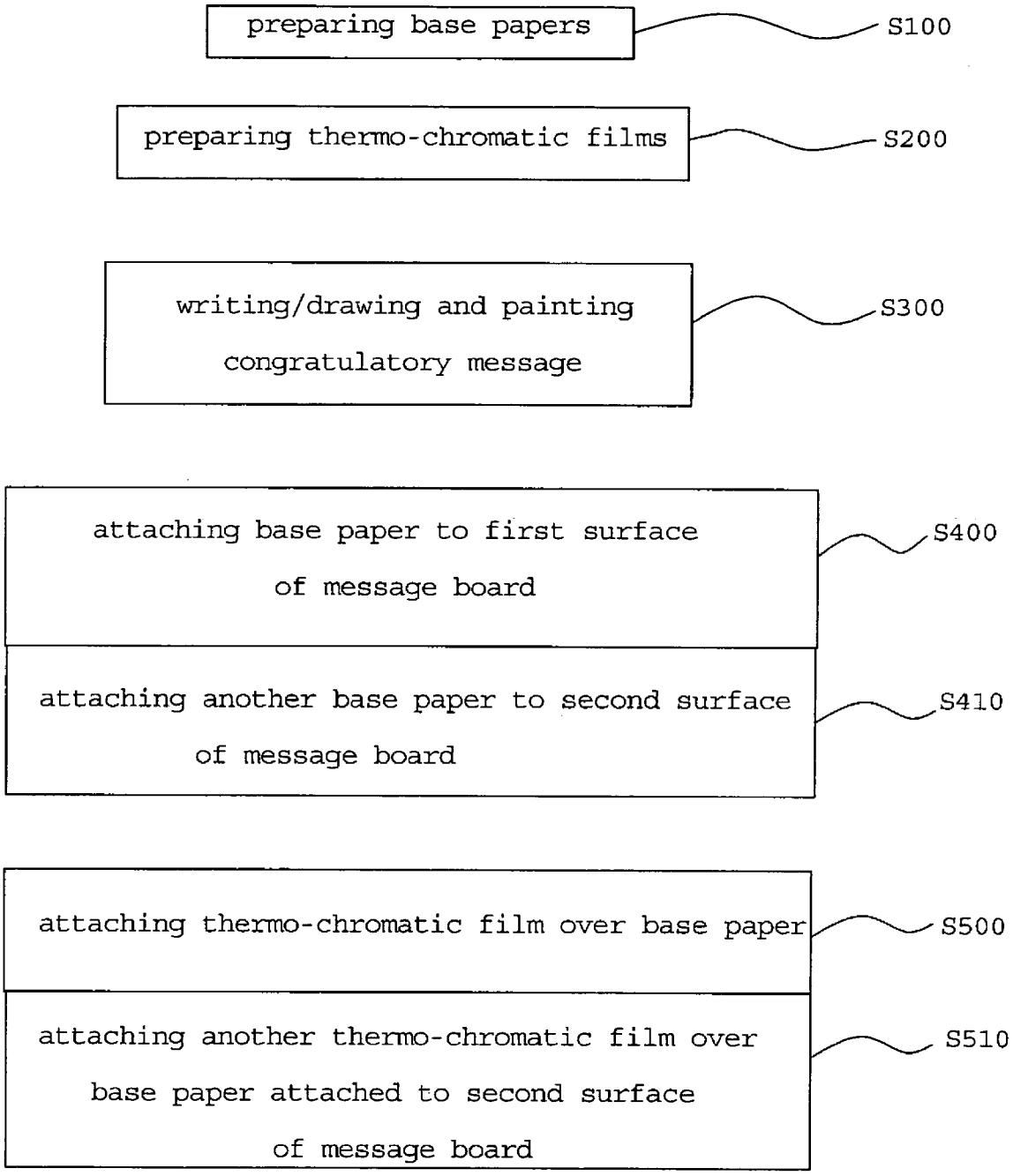

【Figure 2】
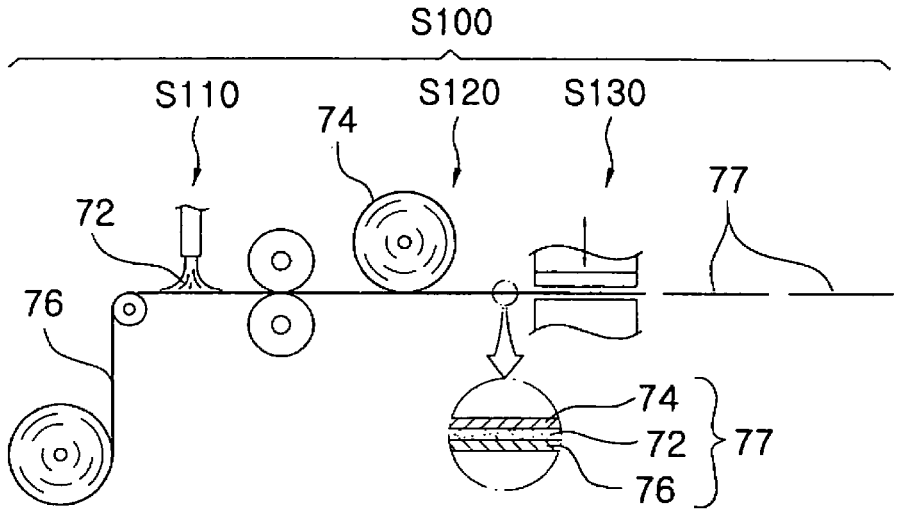
【Figure 3】
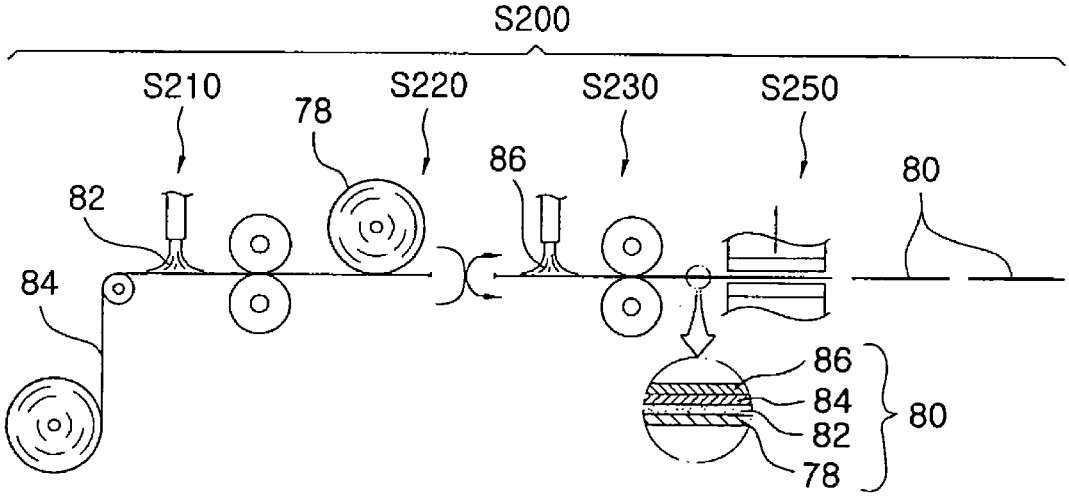

【Figure 4】
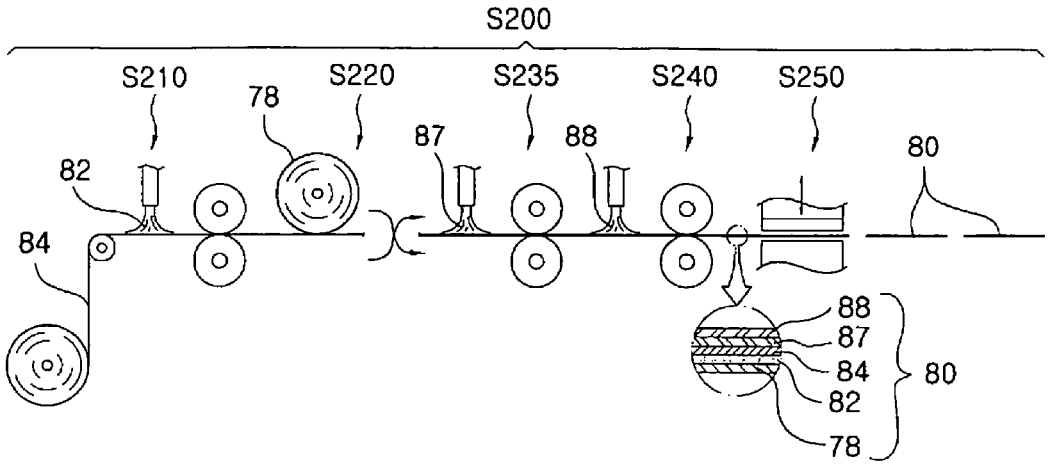
【Figure 5】
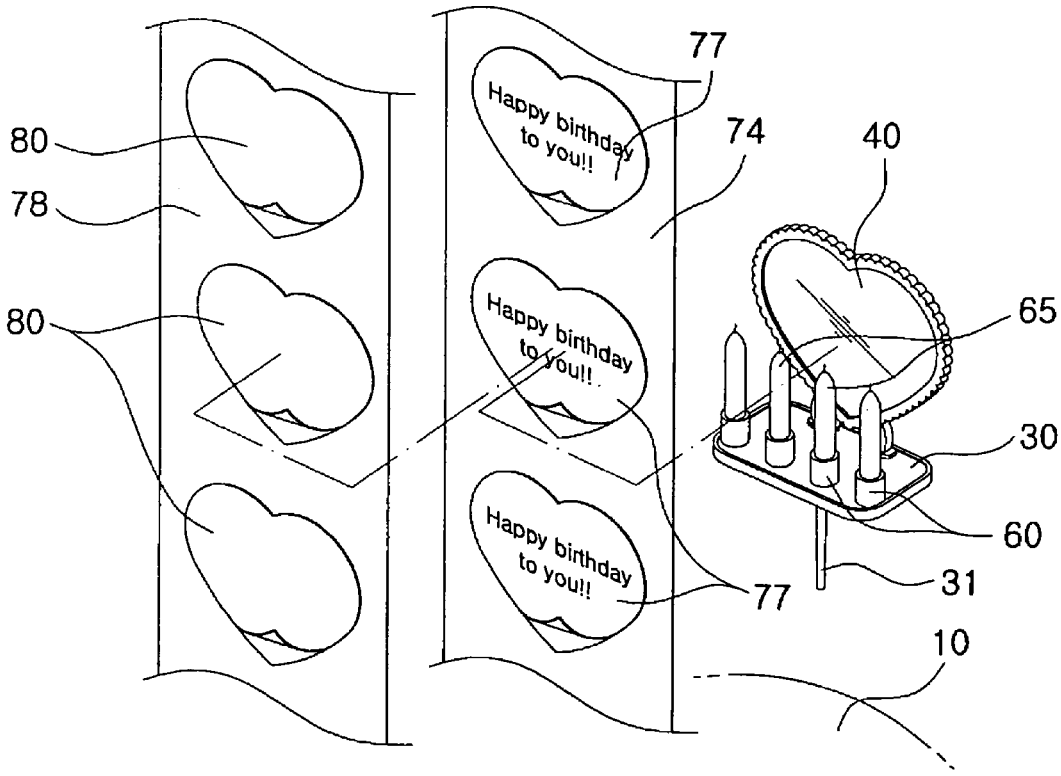

【Figure 6】
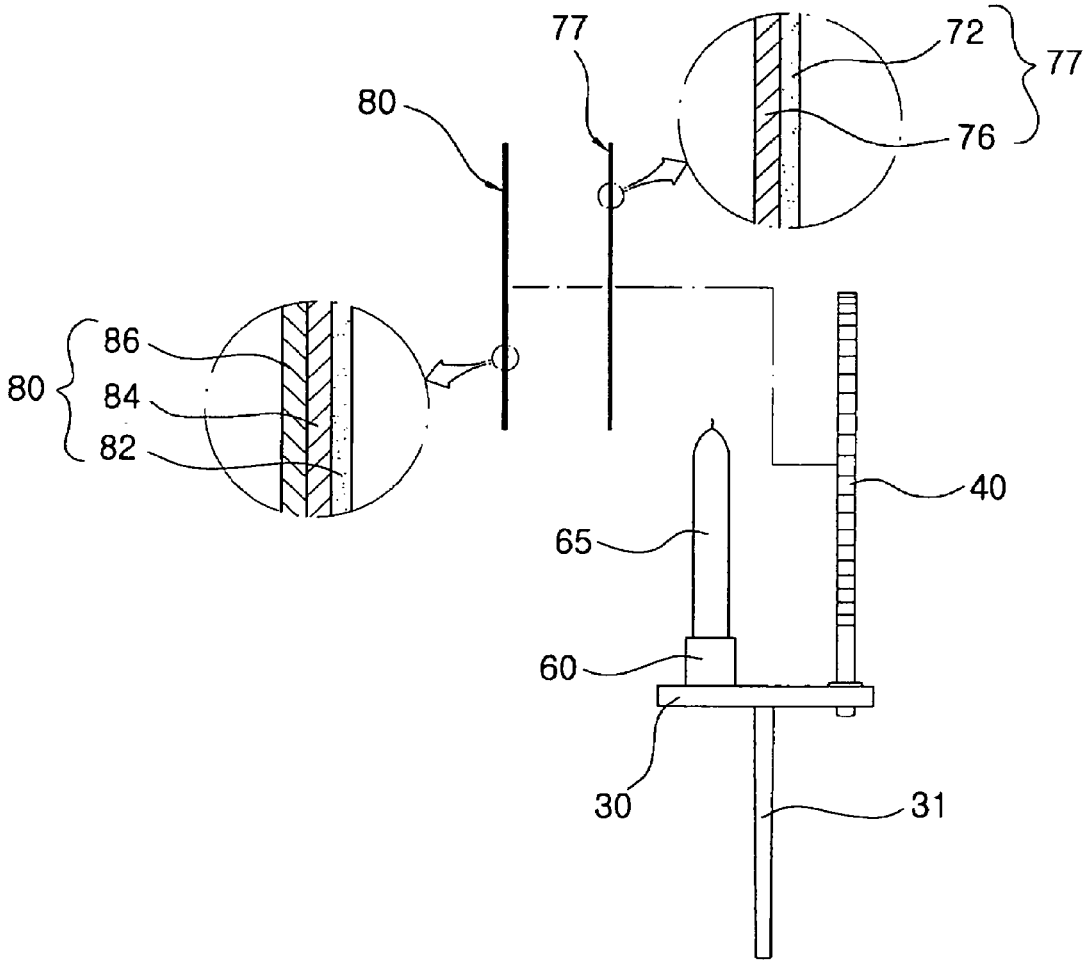
【Figure 7】
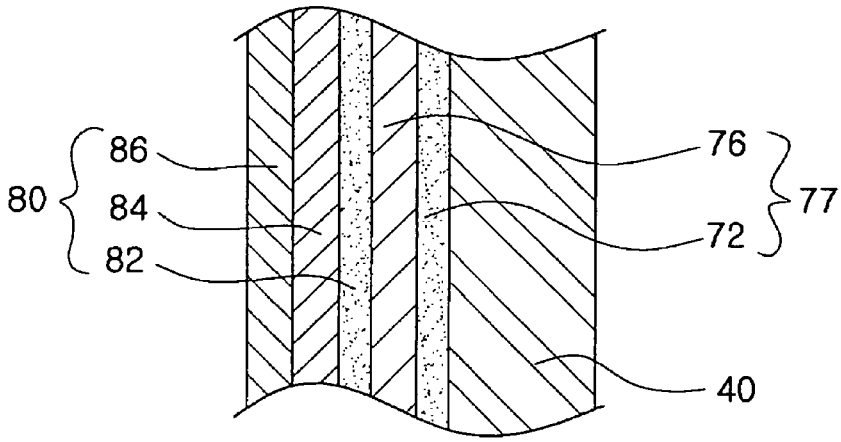

【Figure 8】
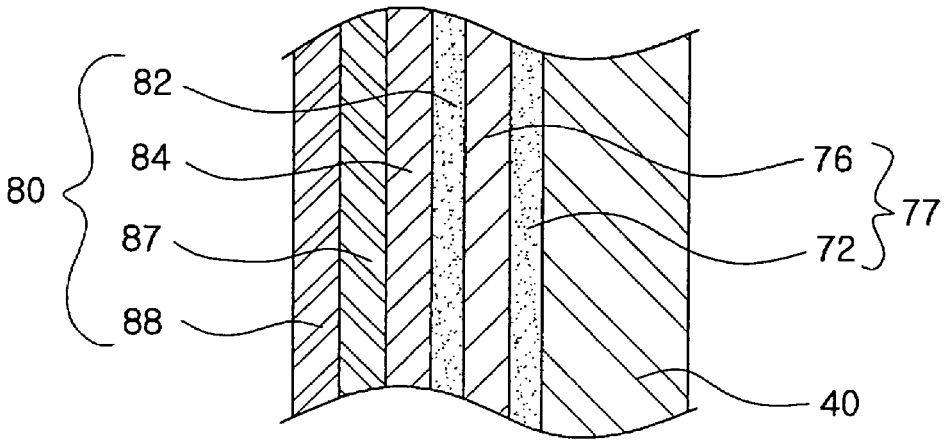
【Figure 9】
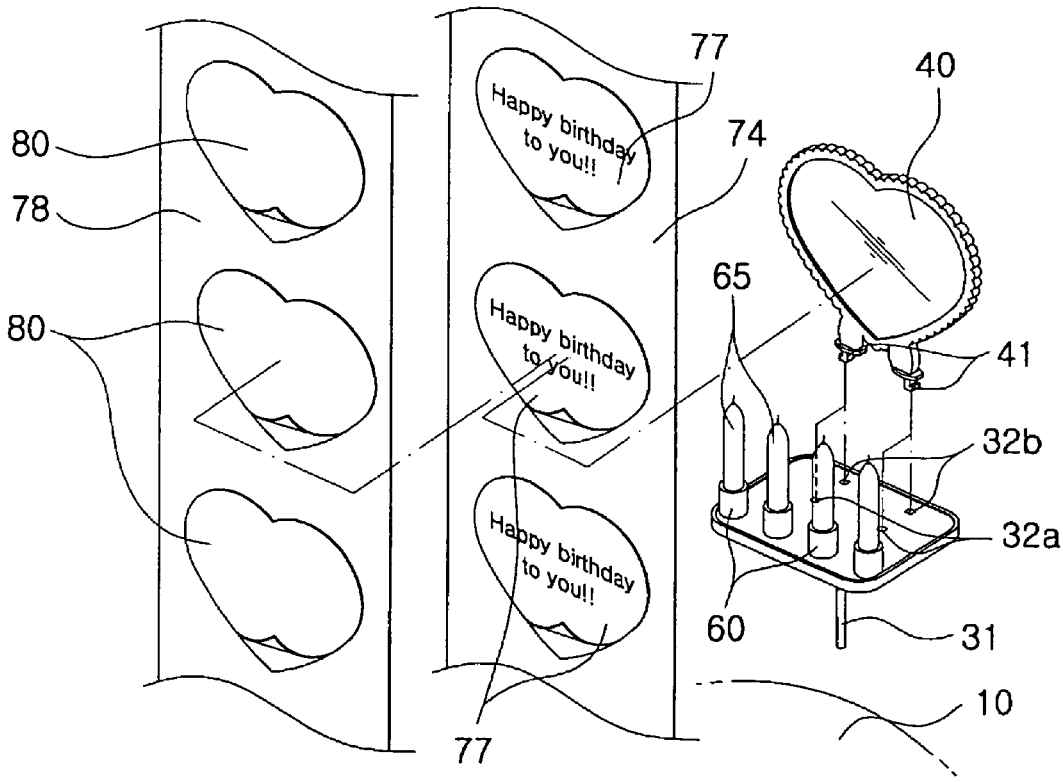

【Figure 10】
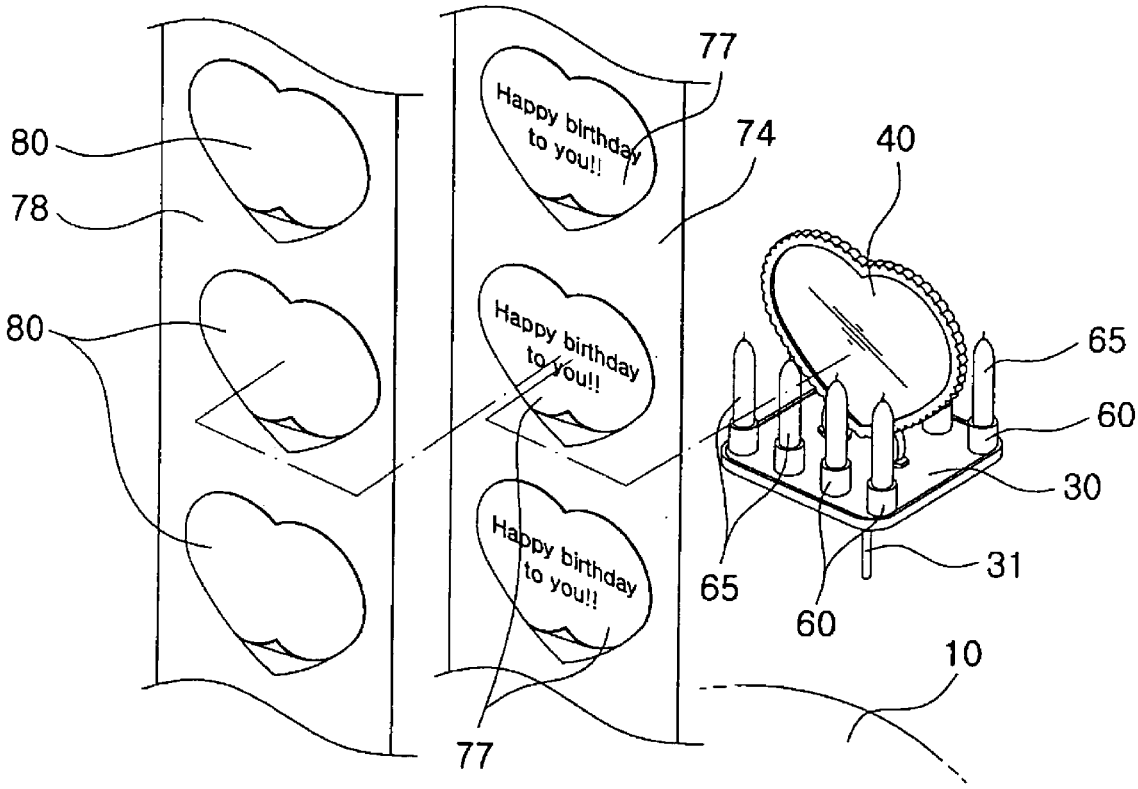

【Figure 11】
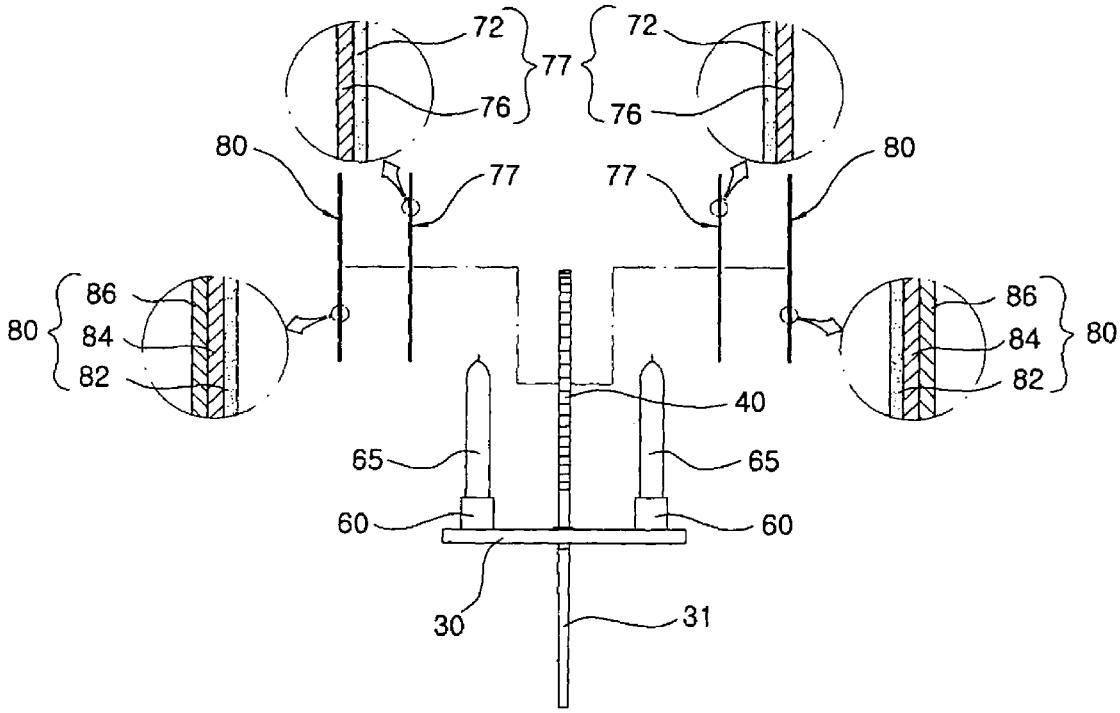

【Figure 12】
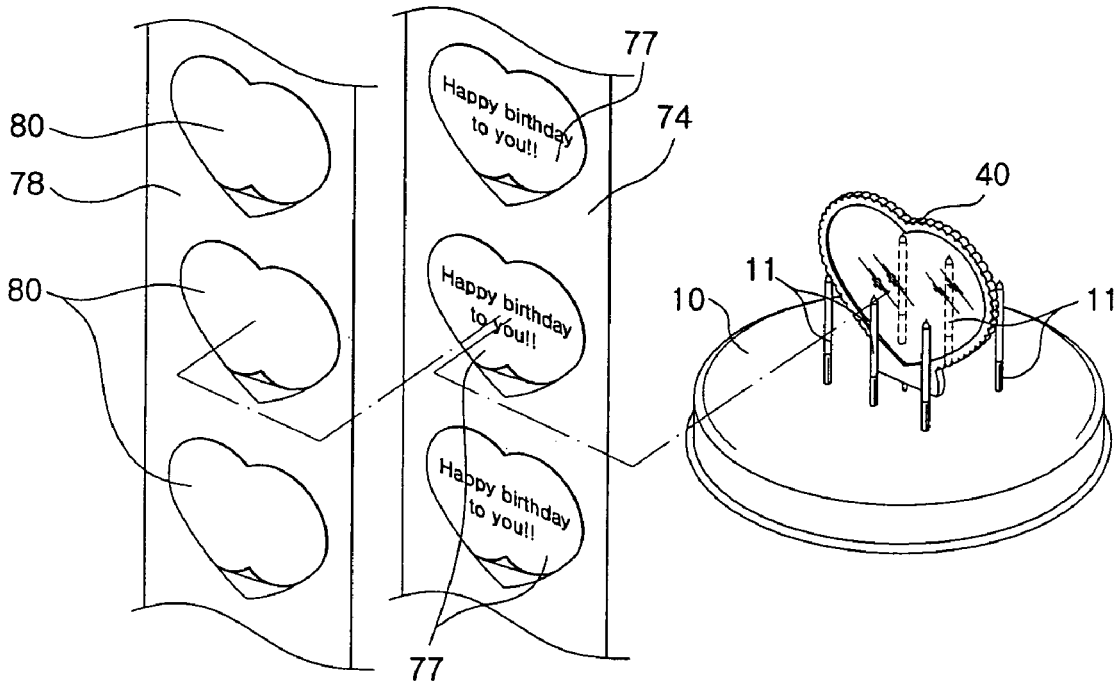

METHOD FOR MANUFACTURING CAKE DECORATING ACCESSORY AND THE DECORATING ACCESSORY

TECHNICAL FIELD

The present invention relates, in general, to methods for manufacturing cake decorating accessories and the decorating accessories and, more particularly, to a method for manufacturing a cake decorating accessory and the decorating accessory, which is used in producing a more dramatic and attractive atmosphere in places where various celebratory events, such as birthdays or anniversaries, are held, through a congratulatory message or picture being displayed by heat transferred from a heating unit.

BACKGROUND ART

Generally, a cake is a kind of dessert made by baking dough in which butterfat, eggs, sugar, milk and spices, etc. are mixed with wheat flour which is the main ingredient of the cake. According to the dough and cooking method, cakes are classified into a sponge cake, a butter cake, a pâte à choux dough cake, a yeast dough cake and a cookie dough cake.

After a cake is made by baking the dough, the cake is decorated with a coated and squeezed icing. Coated icing means that various coating materials are spread on or cover the cake. Squeezed icing means that a cook decorates the cake with a desired line or shape using squeezing bags containing various squeezing materials.

The above-mentioned coated and squeezed icing is made of chocolate, creams, a meringue which is made by whipping the white of an egg mixed with sugar, and a marzipan which is dough made by mixing almond powder with syrup. Particularly, in the creams for the coated and squeezed icing, there are a whipping cream made by whipping a fresh cream including sugar, a butter cream in which an egg and sugar are included in butter, a ganache made by mixing chocolate with a fresh cream, and a grass royal which is used for a wedding cake decoration and is made by mixing sugar, the white of egg, lemon juice and tartaric acid.

Furthermore, accessories, such as a sugar flower, nuts, and a harmless sign plate which is made by printing desired figures and letters on rice paper made of rice using an edible ink, are placed on the cake decorated with the coated and squeezed icing, thus completing the cake decoration.

In addition, various sugar dolls or candles may be fastened to the cake for decoration and to express a special congratulatory message.

For example, a wedding doll or candles to show the age of a person celebrating a birthday are fastened to the cake, so that the atmosphere of the celebratory event, such as a birthday or anniversary, is joyful.

Typically, upon buying a cake, candles, knives, firecrackers, and cards are provided along with the cake. The above-mentioned accessories are useful to create a festive and joyful atmosphere at the celebratory event, such as a birthday or anniversary.

However, limitations are imposed on producing such an atmosphere using conventional cake accessories. Candles, which are provided with the cake, have simple shapes and functions. Accordingly, it is difficult to produce more beautiful and varied atmospheres by candlelight resulting from several candles. Thus, a new decorating means has been desired to solve the above-mentioned problems.

In an effort to overcome the above-mentioned problems experienced with conventional cake accessories, a cake decorating accessory for the climax of the celebratory event was proposed in Korean Patent Laid-open Publication No. 2004-0040637, which was filed by the inventor of the present invention, entitled 'CAKE DECORATING ACCESSORY'.

In the conventional cake decorating accessory disclosed in No. 2004-0040637, a congratulatory message screening on a transfer paper is displayed by heat transferred from a heating unit. The conventional cake decorating accessory includes a base which has the heating unit and a display unit provided on the base.

The base further has a support pin at a lower surface thereof, so that the base is easily and stably attached to the cake. The heating unit and the display unit are provided on the base opposite each other.

The display unit includes transfer paper with thermo-chromatic microcapsules. The display unit displays a congratulatory message on the transfer paper while responding to the heat transferred from the heating unit. The heating unit has a plurality of candles. Candlelight provided by the candles functions to transfer heat to the display unit, and as well, to produce a graceful and mysterious atmosphere. Thus, the atmosphere of the celebratory events, such as birthdays or anniversaries, is beautifully created.

In the meantime, another conventional cake decorating accessory was proposed in Korean Patent Application No. 2003-17031, which was filed by the inventor of the present invention, entitled 'CAKE DECORATING ACCESSORY WITH MESSAGE DISPLAY FUNCTION'.

This conventional cake decorating accessory includes a decorating plate which has a support pin at a lower surface of the decorating plate, thus being fastened to a cake. The cake decorating accessory further includes a heating unit and a message board which are provided on the decorating plate opposite each other. A thermo-chromatic transfer paper is attached to the message board.

In the conventional cake decorating accessories, birthday or anniversary congratulatory messages are printed on the transfer papers, before thermo-chromatic microcapsules are layered on the transfer papers. By heat transferred from the heating unit to the display unit, outer layers of the transfer papers become colorless. Therefore, the printed congratulatory messages are exposed to the outside. Thus, the atmosphere of the celebratory events, such as birthdays or anniversaries, reaches the climax.

However, in the cake decorating accessory disclosed in No. 2004-0040637 and the cake decorating accessory with the message display function disclosed in No. 2003-17031, users cannot directly write the congratulatory messages that become exposed to the outside when the outer layers of the transfer papers become colorless. Therefore, the users cannot express individual congratulatory messages. Thus, the conventional cake decorating accessories cannot accommodate the recent trend of customizing the congratulatory message. To solve the above-mentioned problems, a new cake decorating accessory is required.

DISCLOSURE

Technical Problem

Accordingly, the present invention has been made keeping in mind the above-mentioned problems occurring in the prior art, and an object of the present invention is to provide a cake decorating accessory, in which a congratulatory message printed on transfer paper is gradually displayed by heat transferred from the heating unit, whereby the atmosphere of places where various celebratory events are held reaches the climax, and which is capable of producing more pleasant and various atmospheres through a variously shaped base and candlelight from a plurality of candles.

Another object of the present invention is to provide a cake decorating accessory which allows a user to directly write a congratulatory message on transfer paper, so that the congratulatory message is displayed when an outer layer of the transfer paper becomes colorless, thus expressing the individual congratulatory message, thereby accommodating the recent trend of customizing the congratulatory message.

Technical Solution

In an aspect, the present invention provides a method for manufacturing a cake decorating accessory having a base with a plurality of candlestands linearly provided on an upper surface of the base and spaced apart from each other at regular intervals to support candles thereon, and a support pin provided under a lower surface of the base; and a message board provided on the upper surface of the base at a predetermined distance from the candlestands. The method includes preparing a plurality of base papers cut in a same shape as a shape of the message board; preparing a plurality of thermo-chromatic films cut in a same shape and a same size as the shape and size of the base papers; writing or drawing desired letters or pictures for congratulatory messages on the base papers; attaching one base paper with a desired letter or picture to a first surface of the message board after detaching the base paper from a first protective sheet; and attaching one thermo-chromatic film over the base paper provided on the message board after detaching the thermo-chromatic film from a second protective sheet.

The preparing of the plurality of base papers may further include applying a bonding agent on a first surface of a raw paper which is not coated to allow for writing or drawing thereon with a water-based or oil-based pen, pigments, or a fluorescent pen and color paints; feeding the raw paper after temporarily attaching the first protective sheet to the raw paper with the bonding agent; and cutting the raw paper to which the first protective sheet has been temporarily attached with the bonding agent into pieces having a shape corresponding to the shape of the message board while continuously feeding the raw paper, thus preparing the plurality of base papers.

The preparing of the plurality of thermo-chromatic films may further include applying a transparent bonding agent on a first surface of a transparent synthetic resin film; feeding the transparent synthetic resin film, turned upside down, after temporarily attaching the second protective sheet to the first surface of the transparent synthetic resin film with applied transparent bonding agent; applying an oil-based microcapsule ink to a second surface of the transparent synthetic resin film while feeding the transparent synthetic resin film in a state of being turned upside down; and cutting the transparent synthetic resin film into pieces having a same shape and a same size as the shape and size of the base papers while continuously feeding the transparent synthetic resin film to which the bonding agent, to temporarily attach the second protective sheet thereon, and the oil-based microcapsule ink are applied, thus preparing the plurality of thermo-chromatic films.

The preparing of the plurality of thermo-chromatic films may further include applying a transparent bonding agent to a first surface of a transparent synthetic resin film; feeding the transparent synthetic resin film, turned upside down, after temporarily attaching the second protective sheet to the first surface of the transparent synthetic resin film with applied transparent bonding agent; applying a water-based microcapsule ink to a second surface of the transparent synthetic resin film while feeding the transparent synthetic resin film in a state of being turned upside down; layering a transparent resin on the water-based microcapsule ink applied on the second surface of the transparent synthetic resin film; and cutting the transparent synthetic resin film into pieces having a same shape and a same size as the shape and size of the base papers while continuously conveying the transparent synthetic resin film to which the bonding agent, to temporarily attach the second protective sheet thereon, and the water-based microcapsule ink and the transparent resin are applied, thus preparing the plurality of thermo-chromatic films.

The attaching of the base paper with the desired letter or picture to the first surface of the message board may further include attaching another base paper to a second surface of the message board.

The attaching of the thermo-chromatic film over the base paper provided on the message board may further include attaching another thermo-chromatic film over the base paper attached to the second surface of the message board.

In another aspect, the present invention provides a cake decorating accessory, including a base with a plurality of candlestands linearly provided on an upper surface of the base to be spaced apart from each other at regular intervals to support candles thereon, and a support pin provided under a lower surface of the base; and a message board provided on the upper surface of the base at a predetermined distance from the candlestands. The cake decorating accessory further includes a raw paper layer; a first bonding agent layer applied to a first surface of the raw paper layer; a second bonding agent layer attached to a second surface of the raw paper layer of a base paper comprising the raw paper layer and the first bonding agent layer; a transparent synthetic resin film layer having the second bonding agent layer on a first surface thereof and attached to the raw paper layer; and an oil-based microcapsule ink layer applied to a second surface of the transparent synthetic resin film layer.

In a further aspect, the present invention provides a cake decorating accessory, including a base with a plurality of candlestands linearly provided on an upper surface of the base and spaced apart from each other at regular intervals to support thereon candles, and a support pin provided under a lower surface of the base; and a message board provided on the upper surface of the base at a predetermined distance from the candlestands. The cake decorating accessory further includes a raw paper layer; a first bonding agent layer applied to a first surface of the raw paper layer; a second bonding agent layer attached to a second surface of the raw paper layer of a base paper comprising the raw paper layer and the first bonding agent layer; a transparent synthetic resin film layer having the second bonding agent layer on a first surface thereof and attached to the raw paper layer; a water-based microcapsule ink layer applied to a second surface of the transparent synthetic resin film layer; and a transparent resin layer applied to the water-based microcapsule ink layer.

ADVANTAGEOUS EFFECTS

In the present invention having the above-mentioned construction, a user writes a desired congratulatory message on the base paper. Thereafter, the base paper is attached to the message board after being detached from the first protective sheet. The thermo-chromatic film is attached over the base paper after being detached from the second protective sheet. Therefore, while the thermo-chromatic film becomes colorless due to the heat transferred from the candles, the congratulatory message on the base paper is gradually displayed.

DESCRIPTION OF DRAWINGS

The above and other objects, features and other advantages of the present invention will be more clearly understood from the following detailed description taken in conjunction with the accompanying drawings, in which:

FIG. 1 is a block diagram showing a method for manufacturing a cake decorating accessory, according to the present invention;

FIG. 2 is a partial process view showing a step of preparing a plurality of base papers in the method shown in FIG. 1;

FIG. 3 is a partial process view showing a step of a preparing a plurality of thermo-chromatic films in the method shown in FIG. 1;

FIG. 4 is a partial process view showing a step of preparing another plurality of thermo-chromatic films in the method shown in FIG. 1;

FIG. 5 is a perspective view showing the construction of a first embodiment of a cake decorating accessory of the present invention manufactured through the method shown in FIG. 1;

FIG. 6 is a side view of the cake decorating accessory of FIG. 5;

FIG. 7 is an enlarged partial sectional view showing a layered structure of a base paper and a thermo-chromatic film used in the cake decorating accessory of FIG. 5;

FIG. 8 is an enlarged partial sectional view showing a layered structure of the base paper and another thermo-chromatic film used in the cake decorating accessory of FIG. 5;

FIG. 9 is a perspective view showing the construction of a second embodiment of a cake decorating accessory of the present invention manufactured through the method shown in FIG. 1;

FIG. 10 is a perspective view showing the construction of a third embodiment of a cake decorating accessory of the present invention manufactured through the method shown in FIG. 1;

FIG. 11 is a side view of the cake decorating accessory of FIG. 10; and

FIG. 12 is a perspective view showing the construction and operation of a fourth embodiment of a cake decorating accessory of the present invention manufactured through the method shown in FIG. 1.

BEST MODE

Hereinafter, the present invention will be described in detail with reference to the attached drawings.

FIG. 1 is a block diagram showing a method for manufacturing a cake decorating accessory, according to the present invention. FIG. 2 is a partial process view showing the step S100 of preparing a plurality of base papers 77 in the method shown in FIG. 1. FIG. 3 is a partial process view showing the step S200 of preparing a plurality of thermo-chromatic films 80 in the method shown in FIG. 1. FIG. 4 is a partial process view showing the step S200 of preparing another plurality of thermo-chromatic films 80 in the method shown in FIG. 1.

AS shown in FIGS. 1 through 4, the method for manufacturing the cake decorating accessory of the present invention includes the step S100 of preparing the plurality of base papers 77, and the step S200 of preparing the plurality of thermo-chromatic films 80. The method further includes the step S300 of writing or drawing desired letters or pictures for congratulatory messages on the base papers 77. The method further includes the step S400 of attaching the base paper 77 with a desired letter or picture to a first surface or both surfaces of a message board 40 after detaching the base paper 77 from a first protective sheet 74. The method further includes the step S500 of attaching the thermo-chromatic film 80 over the base paper 77 provided on the message board 40.

That is, at step S100 of preparing the plurality of base papers 77, the base papers 77 cut in the same shape as that of the message board 40 are prepared. Each base paper 77 is provided to allow a user to directly write or draw desired letters or pictures for congratulatory messages on the base papers 77. Furthermore, the base paper 77 has a temporary or permanent adhesive property.

FIG. 2 shows the partial process view showing a detailed construction of the step S100 of preparing the plurality of base papers 77. As shown in FIG. 2, at step S100, a bonding agent 72 is applied to a first surface of a raw paper 76 at step S110. The raw paper 76 is thereafter fed at step S120 while temporarily attaching the first protective sheet 74 to the raw paper 76. Thereafter, the raw paper 76 is cut into pieces having a shape corresponding to the shape of the message board 40 at step S130 while being continuously fed in a state of being temporarily attached to the first protective sheet 76.

In a detailed description, at step S110, the bonding agent 72 is applied on the first surface of the raw paper 76 which is not coated to allow for writing or drawing thereon with a water-based or oil-based pen, pigments, or a fluorescent pen and painting in colors. At step S120, the raw paper 76 is fed after the first protective sheet 74 is temporarily attached to the first surface of the raw paper 76 on which the bonding agent 72 is applied.

Thereafter, at step S130, the raw paper 76, which is temporarily attached to the first protective sheet 74 by the bonding agent 72, is cut into pieces having a shape corresponding to the shape of the message board 40 while being continuously fed, thus preparing the plurality of base papers 77.

In the meantime, at step S200 of preparing the plurality of thermo-chromatic films 80, the thermo-chromatic films 80, which are cut in the same shape as that of the base paper 40, are prepared. Each thermo-chromatic film 80 has a function of thermally changing color by responding to heat. Furthermore, the thermo-chromatic film 80 has a temporary or permanent adhesive property.

FIG. 3 is the partial process view showing the detailed construction of the step S200 of preparing the plurality of thermo-chromatic films 80. Referring to FIG. 3, the step S200 of preparing the thermo-chromatic films 80 includes the step S210 of applying a transparent bonding agent 82 to a predetermined film 84. The step S200 further includes the step S220 of feeding the predetermined film, turned upside down, after temporarily attaching the second protective sheet 78 to the predetermined film. The step S200 further includes the step S230 of applying and layering an oil-based microcapsule ink 86 on the predetermined film, and the step S250 of cutting the layered predetermined film into pieces having the same shape and size as that of the base paper 77, thus preparing the plurality of thereto-chromatic films 80.

In detail, the transparent bonding agent 82 is applied to a first surface of a transparent synthetic resin film 84 at step S210. At step S220, the transparent synthetic resin film 84 is fed, turned upside down, after the second protective sheet 78 is temporarily attached to the first surface of the transparent synthetic resin film 84 to which the transparent bonding agent 82 has been applied. Thereafter, the oil-based microcapsule ink 86 is applied to a second surface of the transparent synthetic resin film 84 at step S230 while the transparent synthetic resin film 84 is fed in the state of being turned upside down.

At step S250, the transparent synthetic resin film 84, on which the bonding agent 82 is applied to temporarily attach the second protective sheet 78 thereon, and the oil-based microcapsule ink 86 is applied, is cut into pieces having the same shape and size as that of the base papers 77 while being continuously fed, thus preparing the plurality of thermo-chromatic films 80.

FIG. 4 is a partial process view showing the step S200 of preparing the other plurality of thermo-chromatic films 80. As shown in FIG. 4, the step S200 of preparing the thermo-chromatic films 80 may comprise the following steps. That is, the step S200 includes the step S210 of applying a transparent bonding agent 82 to a predetermined film, and the step S220 of feeding the predetermined film, turned upside down, after temporarily attaching the second protective sheet 78 to the predetermined film. The step S200 further includes the step S235 of applying a water-based microcapsule ink 87 to the predetermined film, and the step S240 of layering a transparent resin 88 on the water-based microcapsule ink 87. The step S200 further includes the step S250 of cutting the layered predetermined film into pieces having the same shape and size as that of the base paper 77, thus preparing the plurality of thermo-chromatic films 80.

In detail, the transparent bonding agent 82 is applied to a first surface of a transparent synthetic resin film 84 at step S210. At step S220, the transparent synthetic resin film 84 is fed, turned upside down, after the second protective sheet 78 is temporarily attached to the first surface of the transparent synthetic resin film 84 to with the transparent bonding agent 82 has been applied.

Thereafter, a water-based microcapsule ink 87 is applied to a second surface of the transparent synthetic resin film 84 at step S235 while the transparent synthetic resin film 84 is fed in the state of being turned upside down. At step S240, the transparent resin 88 is layered on the water-based microcapsule ink 87 which is applied to the second surface of the transparent synthetic resin film 84.

At step S250, the transparent synthetic resin film 84, to which the bonding agent 82 is applied to temporarily attach the second protective sheet 78 thereon, and the oil-based microcapsule ink 86 is applied, is cut into pieces having the same shape and size as that of the base papers 77 while being continuously fed, thus preparing the plurality of thermo-chromatic films 80.

After the above-mentioned step S200 is completed, the user writes or draws desired letters or pictures for congratulatory messages on the base papers 77 at step S300. Sequentially, one base paper 77 resulting from the step S300 is detached from the first protective sheet 74 and is attached to the first surface of the message board 40 at step S400. Thereafter, at the final step S500, one thermo-chromatic film 80 is attached over the base paper 77, which is attached to the first surface of the message board 40, after being detached from the second protective sheet 74.

The step S400 of attaching the base paper 77, detached from the first protective sheet 74, to the first surface of the message board 40 may include the step S410. At step S410, another base paper 77 is attached to a second surface of the message board 40 after detaching the base paper 77 from another first protective sheet 74.

In the meantime, the step S500 of attaching the thermo-chromatic film 80, detached from the second protective sheet 78, over the base paper 77 provided on the message board 40 may include the step S510. At step S510, another thermo-chromatic film 80, detached from another second protective sheet 78, is attached over the base paper 77 attached to the second surface of the message board 40.

As described above, the cake decorating accessory of the present invention is provided by the above-mentioned cake decorating accessory manufacturing method. As shown in FIGS. 2 through 12, the cake decorating accessory of the present invention includes a raw paper layer 76, a first bonding agent layer 72, a second bonding agent layer 82, a transparent synthetic resin film layer 84, and an oil-based microcapsule ink layer 86.

The raw paper layer 76 is not coated on at least one surface thereof to allow for writing or drawing thereon a congratulatory message using a water-based or oil-based pen, pigments, or a fluorescent pen and color paints. The first bonding agent layer 72 is applied to the raw paper layer 76. The raw paper layer 76 and the first bonding agent layer 72 constitute the base paper 77.

A first protective sheet layer 74 is temporarily attached to the first bonding agent layer 72 of the base paper 77. Thus, as desired, the base paper 77 comprising the raw paper layer 76 and the first bonding agent layer 72 can be easily detached from the first protective sheet layer 74.

In the meantime, according to the individual taste of the user, special letters or pictures for the congratulatory message can be written or drawn on the raw paper layer 76 of the base paper 77 and may be painted in colors. Thereafter, the thermo-chromatic film 80 is attached to the base paper 77 with the desired letter or picture for the congratulatory message.

The above-mentioned thermo-chromatic film 80 includes the second bonding agent layer 82 to be attached to the second surface of the base paper 77 which has the congratulatory message and is attached to the first surface or both surfaces of the message board 40 after being detached from the first protective sheet layer 74.

The second bonding agent layer 82 is applied to a first surface of the transparent synthetic resin film layer 84. The oil-based microcapsule ink layer 86 is applied to a second surface of the transparent synthetic resin film layer 84.

That is, on the message board 40, the first bonding agent layer 72, the raw paper layer 76, the second bonding agent layer 82, the transparent synthetic resin film layer 84 and the oil-based microcapsule ink layer 86 are sequentially layered, as shown in FIG. 7.

As shown in FIG. 8, in place of the oil-based microcapsule ink layer 86, a water-based microcapsule ink layer 87 may be applied to the second surface of the transparent synthetic resin film layer 84, and thereafter, a transparent resin layer 88 may be layered on the water-based microcapsule ink layer 87.

Hereinafter, the constructions and operations of embodiments of the present invention will be described in detail.

FIG. 5 is a perspective view of a cake decorating accessory, according to a first embodiment of the present invention. FIG. 6 is a side view of the cake decorating accessory of FIG. 5. FIG. 7 is an enlarged partial sectional view showing a layered structure of a base paper 77 and a thermo-chromatic film 80 used in the cake decorating accessory of FIG. 5.

As shown in FIGS. 5 through 7, the cake decorating accessory according to the first embodiment includes a base 30, a heating unit and a display unit. The base paper 77 manufactured through the above-mentioned cake decorating accessory manufacturing method is attached to a first surface of the message board 40. Thereafter, the thermo-chromatic film 80, on which a second protective sheet 74 is temporarily attached, is attached over the base paper 77 after being detached from the second protective sheet 74, thus providing the display unit.

In detail, the message board 40 is provided on the base 30 to be perpendicular to the base 30. The base 30 has a support pin 31 which extends downwards from a lower surface of the base 30 to allow the base 30 to be easily and stably mounted on cake 10.

The heating unit includes a plurality of candles 65, and a plurality of candlestands 60 to support thereon the candles 65. The heating unit is provided on an upper surface of the base 30 at a side of a surface of the message board 40 on which the thermo-chromatic film 80 is attached. The candlestands 60 are linearly arranged to be spaced apart from each other.

FIG. 9 is a perspective view of a cake decorating accessory, according to a second embodiment of the present invention. As shown in FIG. 9, the cake decorating accessory according to the second embodiment includes a plurality of coupling holes 32*a* and 32*b* which are provided to the front and rear on both sides of an upper surface of a base 30. A message board 40 is removably coupled to the coupling holes 32*a* or 32*b* on the base 30 such that the coupling holes 32*a* and 32*b* allow the message board 40 to be coupled at one of two positions.

A base paper 77 manufactured by the above-mentioned method for manufacturing the cake decorating accessory is attached to a first surface of the message board 40 which is removably coupled to the base 30. Thereafter, a thermo-chromatic film 80 is attached over the base paper 77 to provide a display unit.

The base 30 of the second embodiment has a support pin 31 which extends downwards from a lower surface of the base 30, in the same manner as that of the first embodiment. A heating unit includes a plurality of candles 65 and a plurality of candlestands 60 in the same manner as that described for the construction of the heating unit of the first embodiment.

In the second embodiment, a plurality of coupling protrusions 41 of the message board 40 is inserted into the coupling holes 32*a*, which are linearly arranged on the base 30, in the winter. Therefore, heat can be rapidly transferred from the heat unit to the message board 40. In the summer, the coupling protrusions 41 of the message board 40 are inserted into the coupling holes 32*b* which are linearly arranged at another position on the base 30. Thus, heat can be slowly transferred from the heat unit to the message board 40.

FIG. 10 is a perspective view showing the construction of a cake decorating accessory, according to a third embodiment of the present invention. FIG. 11 is a side view of the cake decorating accessory of FIG. 10. As shown in FIGS. 10 and 11, the cake decorating accessory according to the third embodiment includes a base 30 having a surface area wider than those of the first and second embodiments. A message board 40 is mounted at a central position on the base 30. Both a base paper 77 and a thermo-chromatic film 80, which are manufactured through the above-mentioned cake decorating accessory manufacturing method, are attached to each surface of the message board 40.

FIG. 12 is a perspective view showing the construction and an operation of a cake decorating accessory, according to a fourth embodiment of the present invention. As shown in FIG. 12, the cake decorating accessory according to the fourth embodiment includes both a message board 40 with a base paper 77 and a thermo-chromatic film 80 which are manufactured through the above-mentioned cake decorating accessory manufacturing method. The message board 40 has a support pin at a lower end thereof. The message board 40 is directly attached to cake. Thereafter, a plurality of candles 11 is put on the cake around the message board 40 having the base paper 77 and the thermo-chromatic film 80. Thus, heat generated from the burning candles 11 changes the thermo-chromatic film 80 into a transparent film.

The operation and effect of the cake decorating accessory of the present invention having the above-mentioned construction will be described herein below.

For the birthday or anniversary ceremonies, a plurality of candles is pinned on a cake 10. At this time, the cake decorating accessory of the present invention is mounted on the cake along with the plurality of candles as shown in FIGS. 5, 9, 10 and 12.

That is, the cake decorating accessory of the present invention is attached to the cake 10 by use of the support pin 31 provided under the lower surface of the base 30. Thereafter, the candles 65, or the candles 11 which are directly attached to the cake 10 are burned. While the candles 65 or 11 are burning, heat is transferred from the candles 65 or 11 to the message board 40 with the thermo-chromatic film 80. Then, the thermo-chromatic film 80 becomes transparent. As a result, congratulatory messages, which were covered by the thermo-chromatic film 80, are exposed to the outside.

The thermo-chromatic film 80 is made by mixing an oil-based ink with thermo-chromatic microcapsules having thermo-chromatic dyes and applying the mixed material to the transparent synthetic resin film 84. The thermo-chromatic dyes included in the thermo-chromatic microcapsules each have a property in which, when the thermo-chromatic microcapsule is heated higher than a referential temperature, a color of the thermo-chromatic dye is changed into a different color, colorlessness or a border color, and, when the thermosensitive microcapsule is cooled lower than the referential temperature, the changed color of the thermo-chromatic dye is restored to the original color. By the above-mentioned property of the thermo-chromatic dye, when the thermo-chromatic film 80 is heated to a temperature higher than a predetermined temperature, the thermo-chromatic film 80 becomes colorless.

Then, the congratulatory message of the base paper 77, which had been covered by the thermo-chromatic film 80, is externally displayed, whereby the atmosphere of the celebratory event reaches the climax. Particularly, a guest of honor at the celebratory event may be impressed by the congratulatory message which is gradually displayed through the heat transfer process.

Furthermore, the congratulatory message is displayed in a joyful atmosphere in which a festive song is sung, or a celebratory message is read. Therefore, the atmosphere of the celebratory event reaches the climax. Thus, more impressive celebratory events can be created. In addition, all the persons participating in the celebratory event, including the guest of honor, are interested in such a gradually displayed message and thus can concentrate on the celebratory event.

In the cake decorating accessory of the present invention, the user can directly write the congratulatory message on the base paper 77 using a water-based or oil-based pen, pigments, or a fluorescent pen, prior to attaching the thermo-chromatic film 80 over the base paper 77. Accordingly, the present invention satisfies the recent trend of personalizing the cake.

In case that the base paper 77 and the thermo-chromatic film 80 are attached to both surfaces of the message board 40, the congratulatory messages are simultaneously displayed on both surfaces of the message board 40. Therefore, the persons participating in the celebratory event can view the congratulatory messages on both sides of the message board 40 which is attached to the cake 10, thus enhancing the effect of the present invention.

The present invention has been described in an illustrative manner, and it should be understood that the terminology used is intended to be in the nature of description rather than of limitation. Many modifications and variations of the present invention are possible in light of the above teachings. For example, the message board 40 may be variously shaped according to the type of event.

That is, in the above-mentioned embodiments of the present invention, the message board 40 has a heart shape. However, the message boards 40 may be manufactured in various shapes according to the congratulatory event, thus creating a more joyful atmosphere. Furthermore, advertisements for a manufacturing company may be displayed on the message board 40, which may be used for product information.

INDUSTRIAL APPLICABILITY

As described above, the present invention provides a cake decorating accessory, in which a congratulatory message on transfer paper can be displayed by burning heat transferred from candles constituting a heating unit, thereby the atmosphere of the place where a celebratory event is held is more mysterious and beautiful and reaches the climax. Furthermore, all the persons participating in the celebratory event, including the guest of honor, are interested in the cake decorating accessory of the present invention and thus can concentrate on the celebratory event.

In addition, the present invention has separate base papers and thermo-chromatic films which are attached to a message board. That is, the cake decorating accessory of the present invention allows a user to directly write a congratulatory message on one base paper using a water-based or oil-based pen, pigments, or a fluorescent pen, before one thermo-chromatic film is attached over the base paper with the congratulatory message. Therefore, the user can express a unique message. As such, the present invention accomplishes the recent trend of individually decorating the cake.

Moreover, the cake decorating accessory may simultaneously display congratulatory messages on both sides of the message board thus enhancing the effect of the present invention.

Furthermore, in the cake decorating accessory of the present invention, the message board may be variously shaped, thus producing a magnificent and varied effect. In addition, letters or logos for advertisements for product information may be displayed on the cake decorating accessory.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a cake decorating accessory having a base with a plurality of candlestands linearly provided on an upper surface of the base and spaced apart from each other at regular intervals to support candles thereon, and a support pin provided under a lower surface of the base; and a message board provided on the upper surface of the base at a predetermined distance from the candlestands, the method comprising:

preparing a plurality of base papers cut in a same shape as a shape of the message board;

preparing a plurality of thermo-chromatic films cut in a same shape and a same size as the shape and size of the base papers;

writing or drawing desired letters or pictures for congratulatory messages on the base papers;

attaching one base paper with a desired letter or picture to a first surface of the message board after detaching the base paper from a first protective sheet; and attaching one thermo-chromatic film over the base paper provided on the message board after detaching the thermo-chromatic film from a second protective sheet.

2. The method according to claim 1, wherein the preparing of the plurality of base papers comprises:

applying a bonding agent on a first surface of a raw paper which is not coated to allow for writing or drawing thereon with a water-based or oil-based pen, pigments, or a fluorescent pen and color paint;

feeding the raw paper after temporarily attaching the first protective sheet to the raw paper with the bonding agent; and cutting the raw paper to which the first protective sheet has been temporarily attached with the bonding agent into pieces having a shape corresponding to the shape of the message board while continuously feeding the raw paper, thus preparing the plurality of base papers.

3. The method according to claim 1, wherein the preparing of the plurality of thermo-chromatic films comprises:

applying a transparent bonding agent to a first surface of a transparent synthetic resin film;

feeding the transparent synthetic resin film, turned upside down, after temporarily attaching the second protective sheet to the first surface of the transparent synthetic resin film with applied transparent bonding agent;

applying an oil-based microcapsule ink to a second, surface of the transparent synthetic resin film while feeding the transparent synthetic resin film in a state of being turned upside down; and cutting the transparent synthetic resin film into pieces having a same shape and a same size as the shape and size of the base papers while continuously feeding the transparent synthetic resin film to which the bonding agent which temporarily attaches the second protective sheet thereon, and the oil-based microcapsule ink are applied, thus preparing the plurality of thermo-chromatic films.

4. The method according to claim 1, wherein the preparing of the plurality of thermo-chromatic films comprises:

applying a transparent bonding agent to a first surface of a transparent synthetic resin film;

feeding the transparent synthetic resin film, turned upside down, after temporarily attaching the second protective sheet to the first surface of the transparent synthetic resin film with applied transparent bonding agent;

applying a water-based microcapsule ink to a second surface of the transparent synthetic resin film while feeding the transparent synthetic resin film in a state of being turned upside down;

layering a transparent resin on the water-based microcapsule ink applied on the second surface of the transparent synthetic resin film; and cutting the transparent synthetic resin film into pieces having a same shape and a same size as the shape and size of the base papers while continuously feeding the transparent synthetic resin film to which the bonding agent which temporarily attaches the second protective sheet thereon, and the water-based microcapsule ink and the transparent resin are applied, thus preparing the plurality of thermo-chromatic films.

5. The method according to claim 1, wherein the attaching of the base paper with the desired letter or picture to the first surface of the message board comprises:

attaching another base paper to a second surface of the message board.

6. The method according to claim 5, wherein the attaching of the thermo-chromatic film over the base paper provided on the message board comprises:

attaching another thermo-chromatic film over the base paper attached to the second surface of the message board.

* * * * *